US007014237B1

(12) United States Patent
Eekhoff et al.

(10) Patent No.: US 7,014,237 B1
(45) Date of Patent: Mar. 21, 2006

(54) CASKET TRANSPORTING APPARATUS

(75) Inventors: David L. Eekhoff, Sioux Center, IA (US); Joel D. Van Den Brink, Rock Rapids, IA (US)

(73) Assignee: Link Mfg., Ltd., Sioux Center, IA (US)

( * ) Notice: Subject to any disclaimer, the term of this patent is extended or adjusted under 35 U.S.C. 154(b) by 0 days.

(21) Appl. No.: 11/041,716

(22) Filed: Jan. 24, 2005

(51) Int. Cl.
*A61G 21/00* (2006.01)

(52) U.S. Cl. ..... 296/16; 414/495; 414/679

(58) Field of Classification Search ..... 296/16, 296/18, 17; 414/495, 540, 679
See application file for complete search history.

(56) References Cited

U.S. PATENT DOCUMENTS 1,925,964 A * 9/1933 Koppe ..... 296/16
4,902,188 A * 2/1990 Page ..... 414/495
5,080,541 A * 1/1992 Andre ..... 410/24.1
5,328,320 A * 7/1994 Farrow et al. ..... 414/495
5,797,712 A * 8/1998 Gearin et al. ..... 410/16
6,450,742 B1 * 9/2002 Jenkins et al. ..... 410/29.1
6,547,509 B1 * 4/2003 Edmo ..... 414/639
6,758,648 B1 7/2004 Eekhoff et al. ..... 414/495
6,932,401 B1 * 8/2005 Eekhoff et al. ..... 296/16

* cited by examiner

*Primary Examiner*—H. Gutman
(74) *Attorney, Agent, or Firm*—Thomte, Mazour & Niebergall; Dennis L. Thomte

(57) ABSTRACT

An apparatus for transporting caskets in a small van including upper and lower decks with the upper deck being movably mounted, with respect to the lower deck, from a lower position wherein the upper deck is adjacent the lower deck to an upper position wherein the upper deck is spaced above the lower deck so that both of the decks may support caskets or the like thereon. The apparatus includes rear supports or legs which are selectively longitudinally adjustably secured to horizontally extending beams so that the apparatus may be placed in vans having wheel housings extending into the cargo compartment thereof.

7 Claims, 9 Drawing Sheets

CASKET TRANSPORTING APPARATUS

BACKGROUND OF THE INVENTION

1. Field of the Invention

This invention relates to an apparatus for transporting caskets in a small van or the like. More particularly, the instant invention relates to a double-deck apparatus including upper and lower decks with the upper deck being selectively movable between upper and lower positions with respect to the lower deck so that both the upper and lower decks may support one or more caskets thereon. Even more particularly, the invention relates to a double-deck apparatus which may be used in small vans having wheel housings projecting inwardly into the cargo compartment thereof.

2. Description of the Related Art

Link Mfg., Ltd. ("Link") of Sioux Center, Iowa, the assignee of this invention, has manufactured Double Deck apparatuses or systems which have been installed in full size Chevrolet, Ford and Dodge vans with the Double Deck systems comprising a lower deck positioned on the floor of the van with an upper deck pivotally mounted thereon and which is movable between upper and lower positions with respect to the lower deck. The upper and lower decks are used to support and transport multiple caskets, cots, stretchers, cremation trays or the like. In the DD200 double-deck system of Link, the upper deck is raised and lowered utilizing an electric actuator with that actuator moving a front torsion bar which lifts the front of the upper deck. In the DD200 Double Deck system of Link, there is a tie rod on each side, running from the front torsion bar to the rear swing arms with the rear swing arms lifting the rear of the upper deck.

Although the DD200 Double Deck system of Link has met with considerable success, the DD200 Double Deck system cannot be installed in certain vans which are smaller than the full size vans described above. To satisfy that need, the invention of U.S. Pat. No. 6,758,648 was developed.

In the United Kingdom and other European countries, the Mercedes Vito and Vauxhall Vivaro vans have wheel housings which extend inwardly into the cargo compartment. Further, the Mercedes Vito has three different wheelbases and the Vauxhall Vivaro has two different wheelbases. In some instances, there is not sufficient space for a support leg between the wheel housing and the rear of the van. Thus, Link's previous designs were difficult, if not impossible, to be installed in those particular vans.

SUMMARY OF THE INVENTION

A double-deck apparatus for transporting caskets is described for use in the cargo area of a small van such as a Mercedes Vito or Vauxhall Vivaro. The apparatus of this invention comprises a generally horizontally disposed lower casket support deck having a forward end, a rearward end, and first and second sides. First and second upstanding supports, having upper and lower ends, are positioned outwardly of the first and second sides of the lower deck, respectively, at the forward end thereof. Third and fourth upstanding supports, having upper and lower ends, are positioned outwardly of the first and second sides of the lower deck, respectively, forwardly of the rearward end of the lower deck. A first side frame or beam, having forward and rearward ends, is mounted on the first and third supports at the upper ends thereof. The forward end of the first side frame is positioned forwardly of the upper end of the first support with the rearward end of the first side frame being positioned rearwardly of the upper end of the third support.

A second side frame, having forward and rearward ends, is mounted on the second and fourth supports at the upper ends thereof. The forward end of the second side frame is positioned forwardly of the upper end of the second support and the rearward end of the second side frame is positioned rearwardly of the upper end of the fourth support. The upper ends of the third and fourth supports are longitudinally adjustably secured to the first and second side frames, respectively.

The apparatus also includes a generally horizontally disposed upper casket support deck having a forward end, a rearward end, and first and second sides. The upper deck is movably positioned above the lower deck between the first, second, third and fourth supports. The upper deck is selectively movable between a lower position and an upper position with the upper deck being spaced above the lower deck when its upper position and being positioned closely adjacent the lower deck when in its lower position. A first hanger bracket assembly is pivotally connected to the first side frame at the forward end thereof and is pivotally connected to the first side of the upper deck at the forward end thereof. A second hanger bracket assembly is pivotally connected to the second side frame at the forward end thereof and is pivotally connected to the second side of the upper deck. A third hanger bracket assembly is pivotally connected to the first side frame member at the rearward end thereof and is pivotally connected to the first side of the upper deck. A fourth hanger bracket assembly is pivotally connected to the second side frame at the rearward end thereof and is pivotally connected to the second side of the upper deck. A first connecting rod is pivotally secured to and extends between the first and second hanger bracket assemblies while a second connecting rod is pivotally secured to and extends between the second and fourth hanger bracket assemblies. An actuator assembly including a body portion and an actuator shaft extending therefrom is mounted on the first side frame and is connected to the first hanger bracket assembly. The first and second hanger bracket assemblies are interconnected so that pivotal movement of the first hanger bracket assembly by the actuator causes the second hanger bracket assembly to pivotally move therewith.

The upper deck is in its upper position when the actuator shaft is in its retracted position and is in its lower position when the actuator shaft is in its extended position. The adjustable connection of the third and fourth supports to the first and second side frames enables the third and fourth supports to be adjustably positioned forwardly of the wheel housings of small vans of various wheelbase lengths.

It is therefore a principal object of the invention to provide an improved casket transporting apparatus.

A further object of the invention is to provide an improved casket transporting apparatus which may be used in small vans having wheel housings protruding into the cargo area thereof.

Still another object of the invention is to provide a casket transporting apparatus which is operated by a single actuator.

Still another object of the invention is to provide a casket transporting apparatus of the type described above which is economical of manufacture, durable in use and refined in appearance.

These and other objects will be apparent to those skilled in the art.

DETAILED DESCRIPTION OF THE INVENTION

Figure 1:
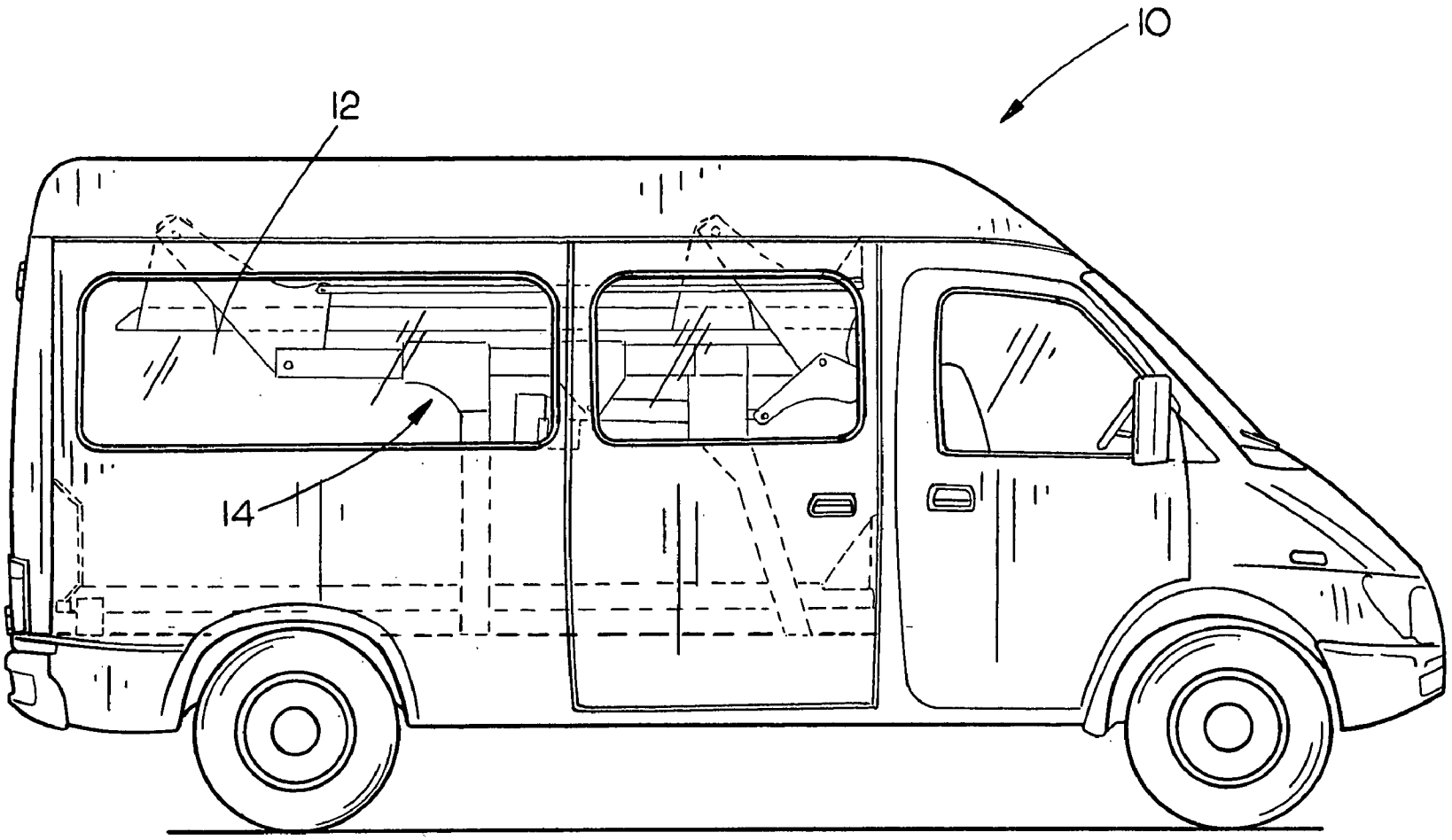
FIG. 1 is a side elevational view of the invention installed in a small van.

The numeral 10 refers generally to a small van or vehicle such as a Mercedes Vito or Vauxhall Vivaro, each of which may have varying wheelbases. Van 10 includes a cargo compartment 12 therein. Normally, wheel housings 13 extend into the compartment 12. The numeral 14 refers to the casket transporting apparatus of this invention. Although the apparatus 14 is ideally suited to transport caskets, it may be used to transport other death care items such as cots, stretchers, cremation trays or the like.

Apparatus 14 includes a lower deck 16 having a forward end 18, rear end 20, and opposite sides 22 and 24. Apparatus 14 also includes an upper deck 26 having a forward end 28, rearward end 30, and opposite sides 32 and 34.

Figure 2:
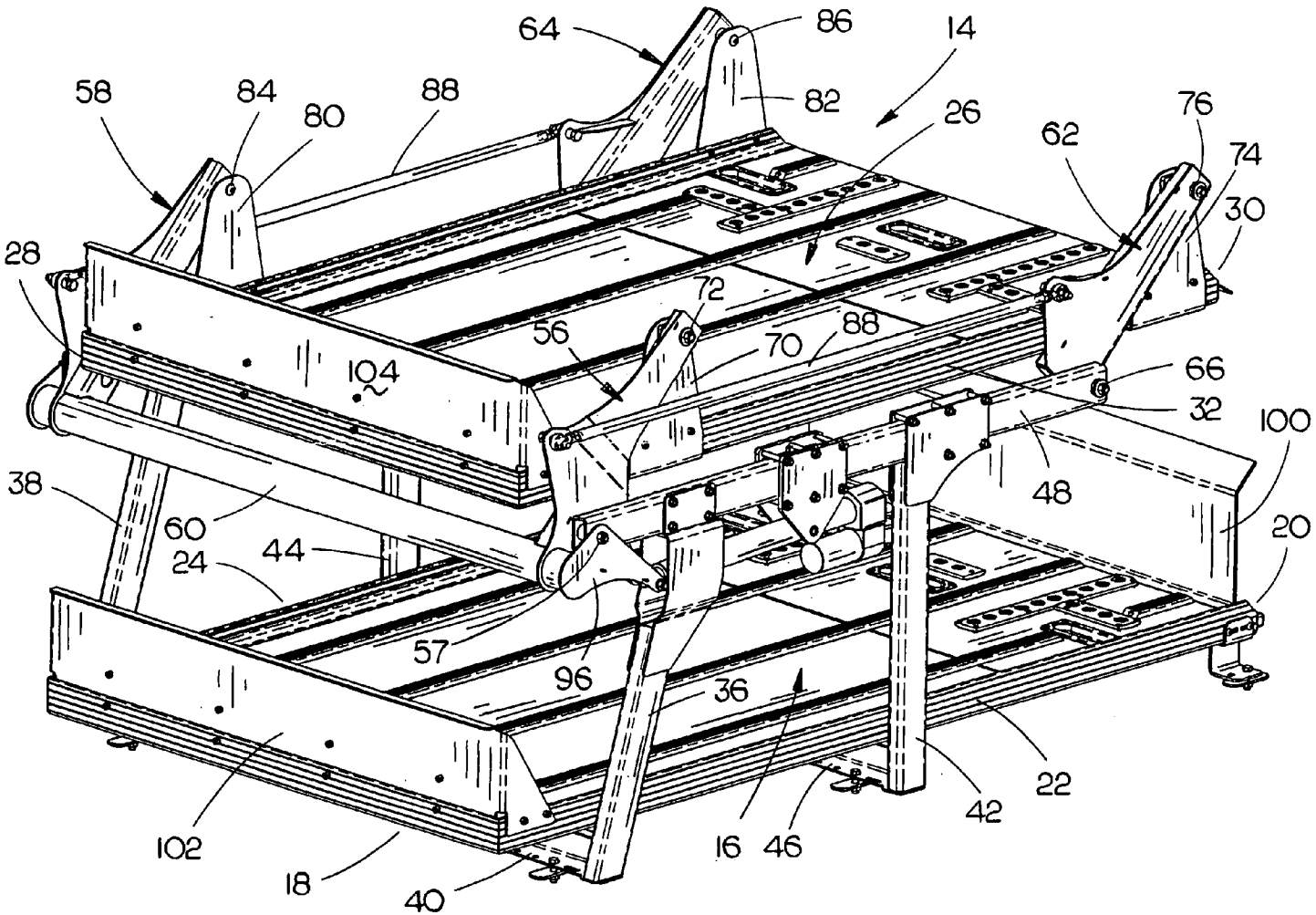
FIG. 2 is a front perspective view of the invention in its transport position, as seen from the left side thereof, with the upper deck in its raised position.
Figure 3:
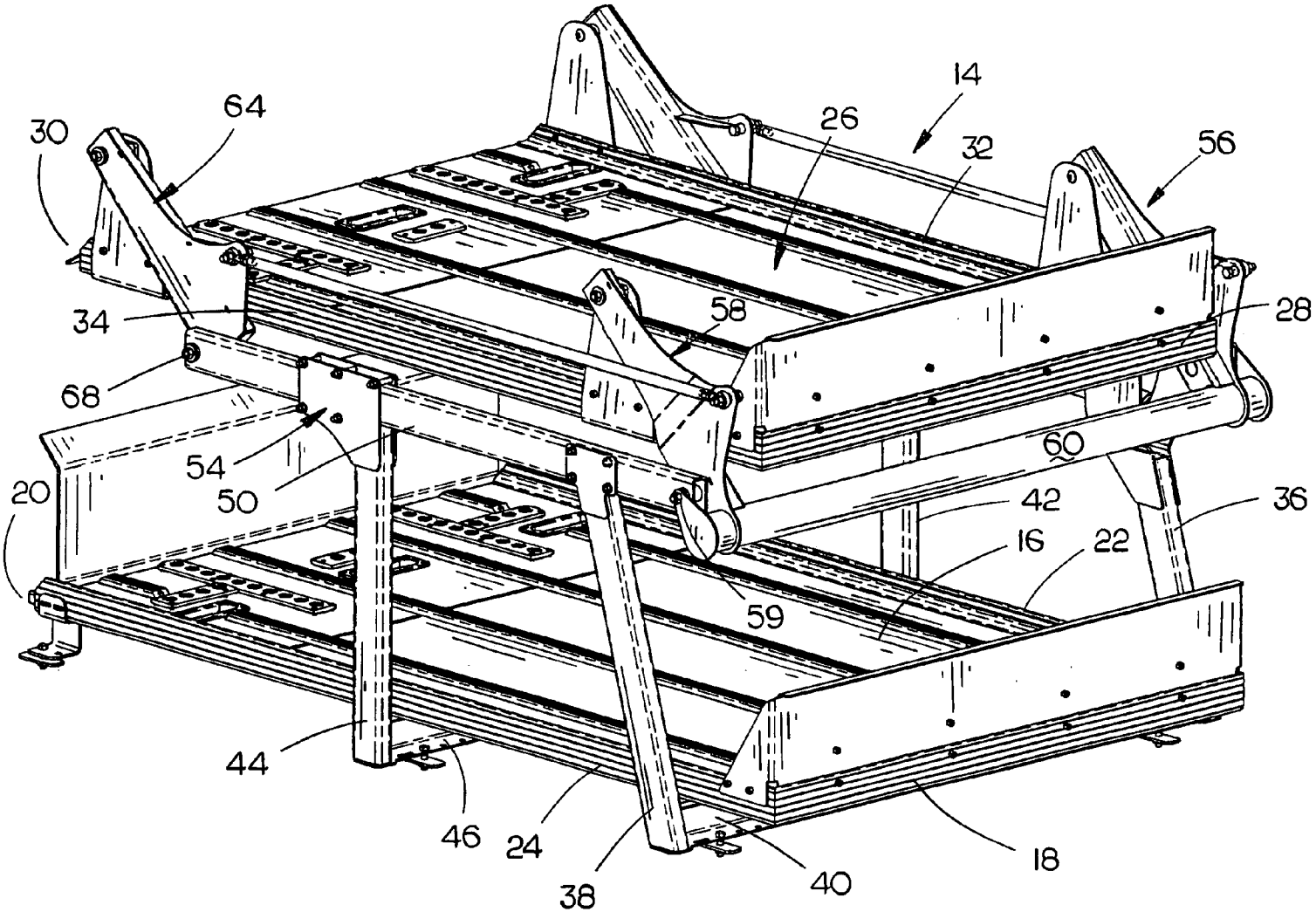
FIG. 3 is a front perspective view of the invention in its transport position, as seen from the right side thereof, with the upper deck in its raised position.
Figure 4:
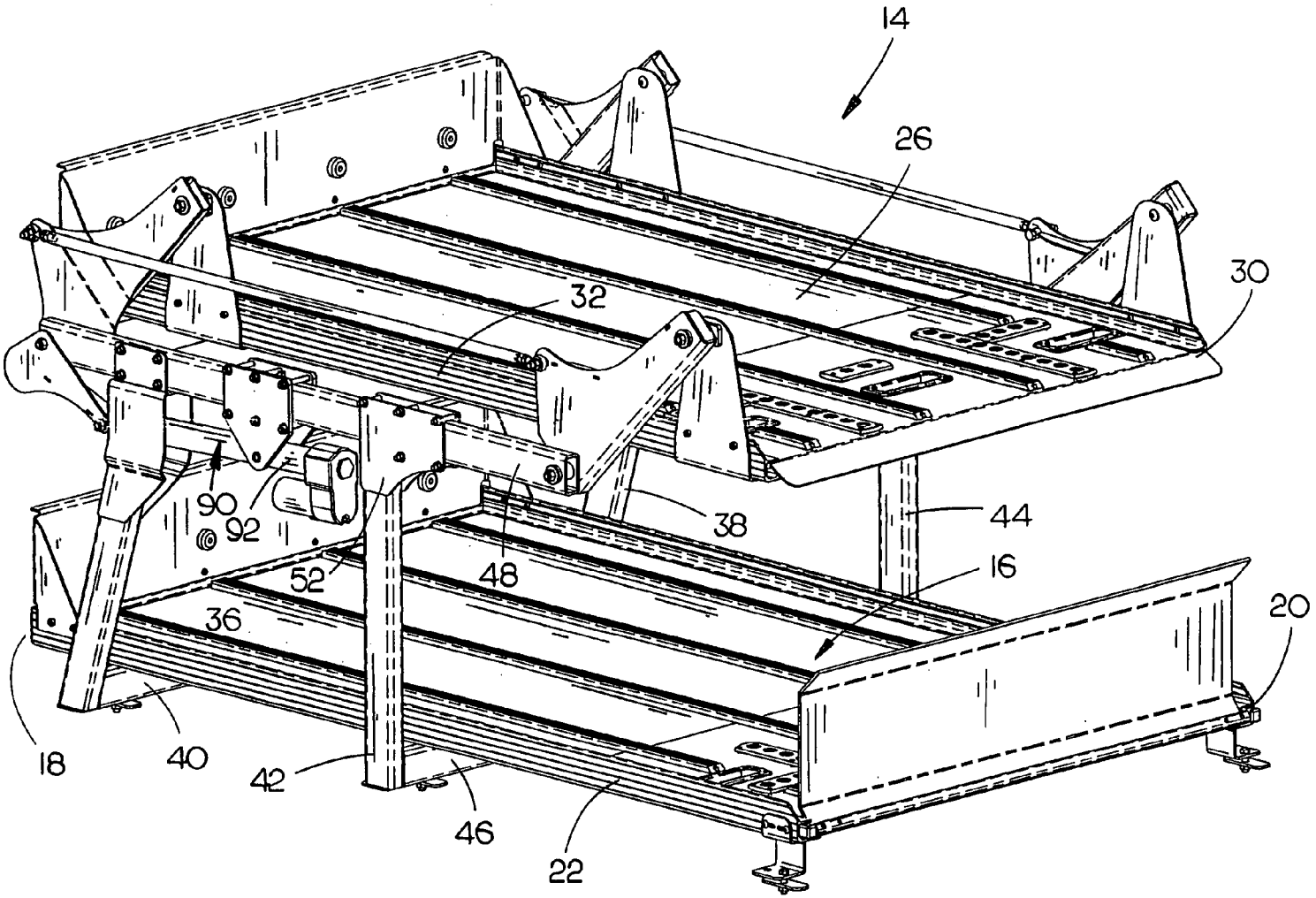
FIG. 4 is a rear perspective view of the invention in its transport position, as seen from the left side thereof, with the upper deck in its raised position.
Figure 5:
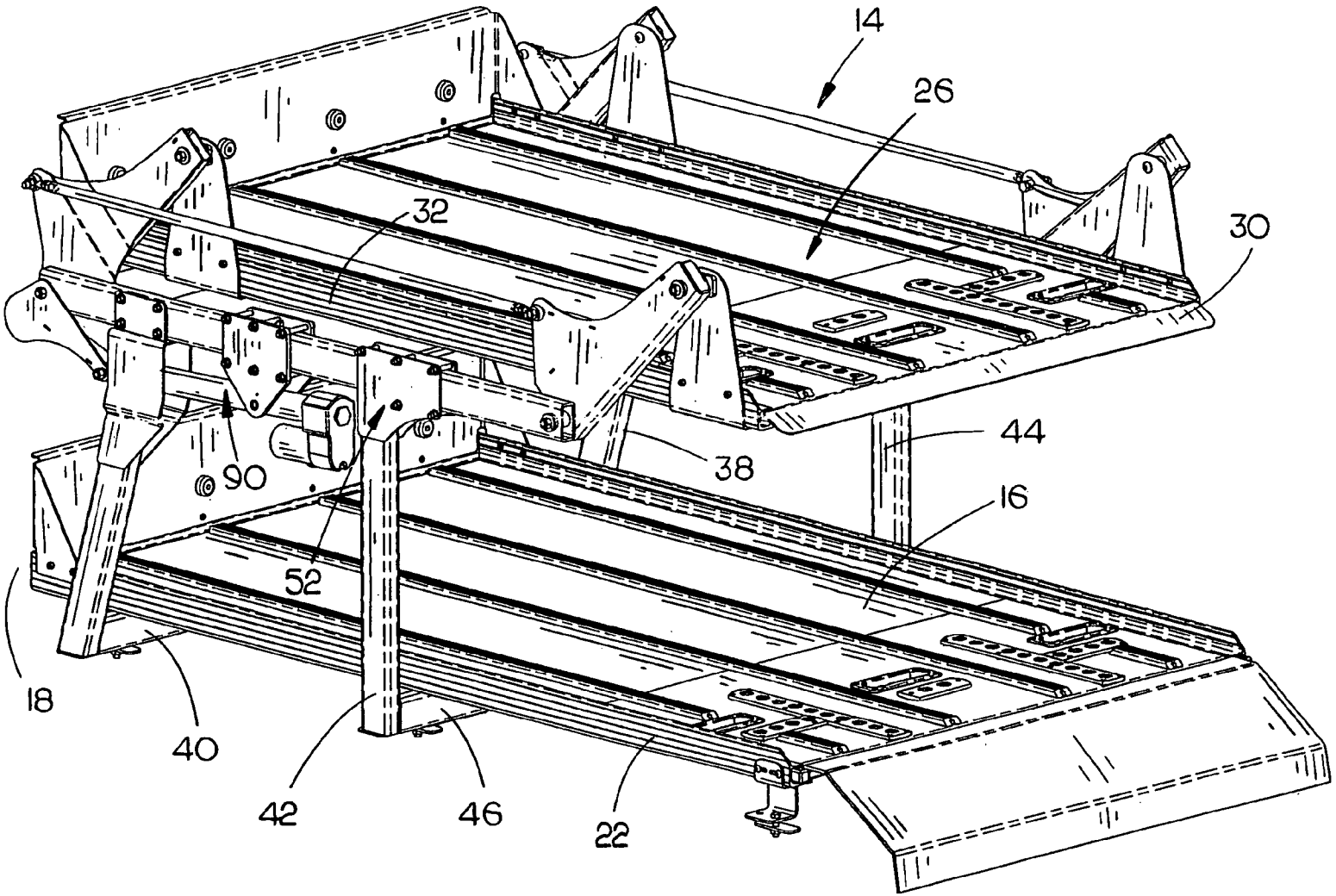
FIG. 5 is a view similar to FIG. 4 except that the ramp at the rearward end of the lower deck is in its loading-unloading position.
Figure 6:
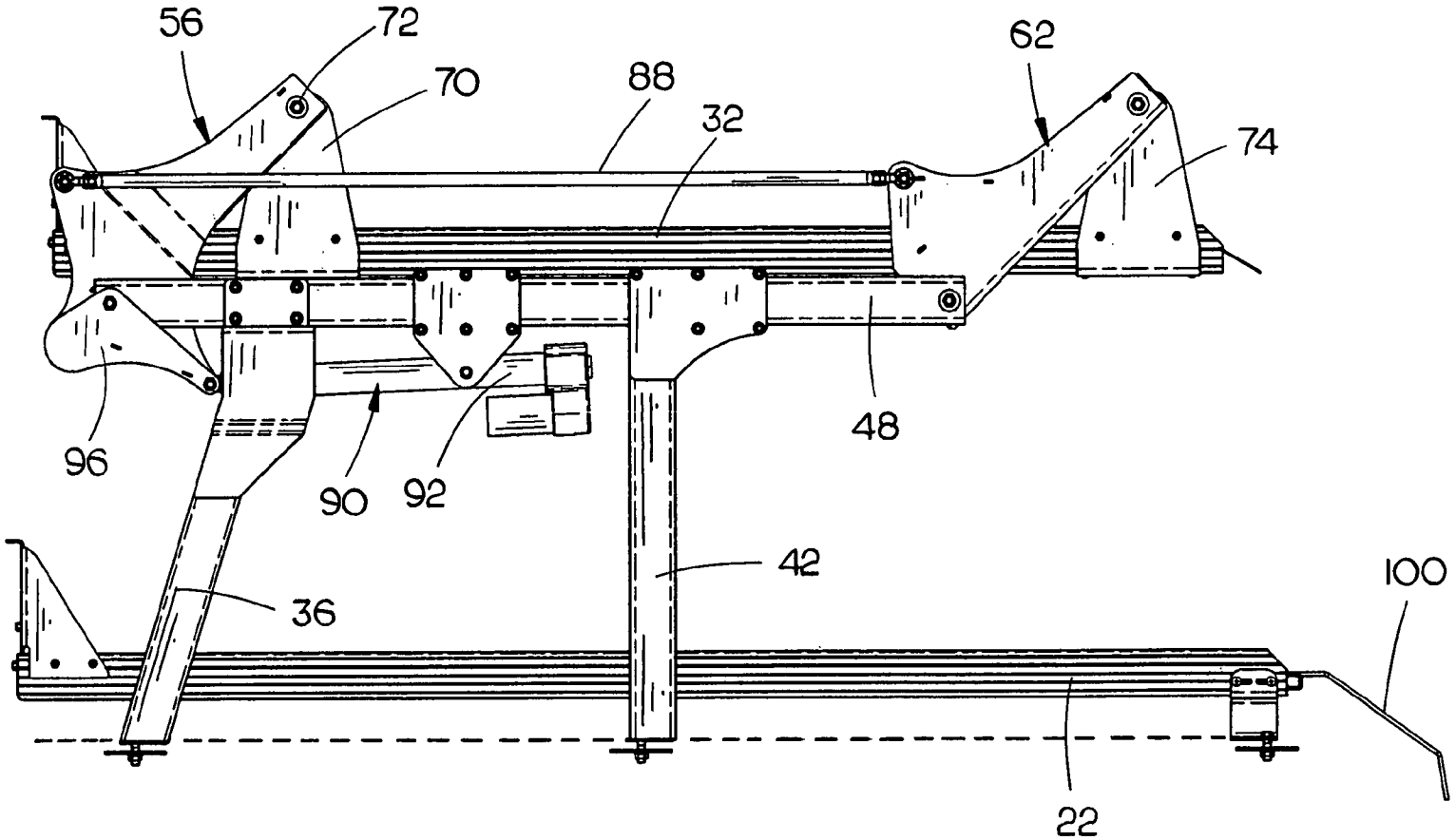
FIG. 6 is a left side view of the invention in the position of FIG. 5.

The numerals 36 and 38 refer to first and second upstanding supports having a frame member 40 secured to the lower ends thereof and extending therebetween. Normally, frame member 40 will be secured to the floor of the vehicle. The numerals 42 and 44 refer to upstanding third and fourth supports, respectively, which have a frame member 46 secured to and extending between the lower ends thereof. Normally, frame member 46 will be secured to the floor of the vehicle. The numerals 48 and 50 refer to generally horizontally disposed side frames or side beams, respectively, which are positioned at the upper ends of the supports 36, 42 and 38, 44, respectively. The upper end of support 36 is bolted to side beam 48 rearwardly of the forward end thereof, as illustrated in FIG. 4. The upper end of support 42 is longitudinally selectively adjustably secured to the side frame 48 by the clamping assembly referred to generally by the reference numeral 52 (FIG. 4). As seen in FIG. 3, the upper end of support 38 is bolted to side frame 50 rearwardly of the forward end thereof. The upper end of support 44 is selectively longitudinally adjustably secured to the side frame 50 by the clamping assembly 54. Hanger bracket assemblies 56 and 58 are pivotally secured to the forward ends of side frames 48 and 50 by pivot pins or bolts 57 and 59, respectively, and are rigidly interconnected by means of a pipe or beam 60 secured thereto and extending therebetween (FIG. 2). Hanger bracket assemblies 62 and 64 are pivotally secured to the rearward ends of side frames 48 and 50, respectively, by means of pivot pins or bolts 66 and 68, respectively.

One end of hanger bracket 56 is pivotally connected to an upstanding plate or bracket 70, which is secured to side 32 of upper deck 26 rearwardly of the forward end thereof by means of a pivot pin or bolt 72. Plate or bracket 74 is secured to side 32 of upper deck 26 with the hanger bracket assembly 62 being pivotally secured thereto by means of pin or bolt 76. Connecting rod 78 is pivotally connected to and extends between the hanger brackets 56 and 62, as seen in FIG. 2.

Plates or brackets 80 and 82 are secured to side 34 of upper deck 26 and have the hanger bracket assemblies 58 and 64 pivotally secured thereto, respectively, by pivot pins or bolts 84 and 86, respectively. Connecting rod 88 is pivotally secured and extends between hanger bracket assemblies 58 and 64, as seen in FIG. 3.

Figure 7:
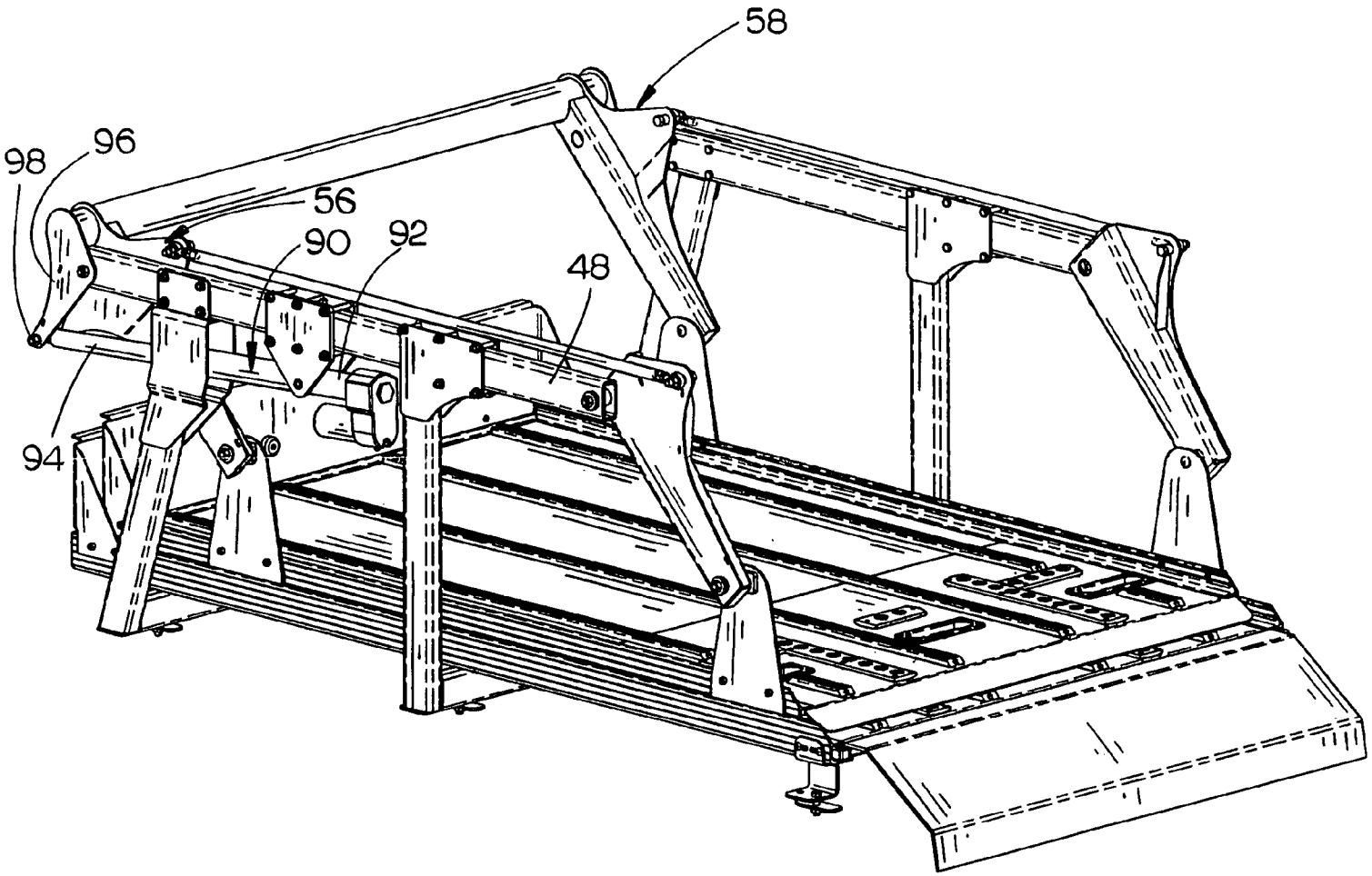
FIG. 7 is a left rear perspective view of the invention with the upper deck in its lowered loading-unloading position.
Figure 8:
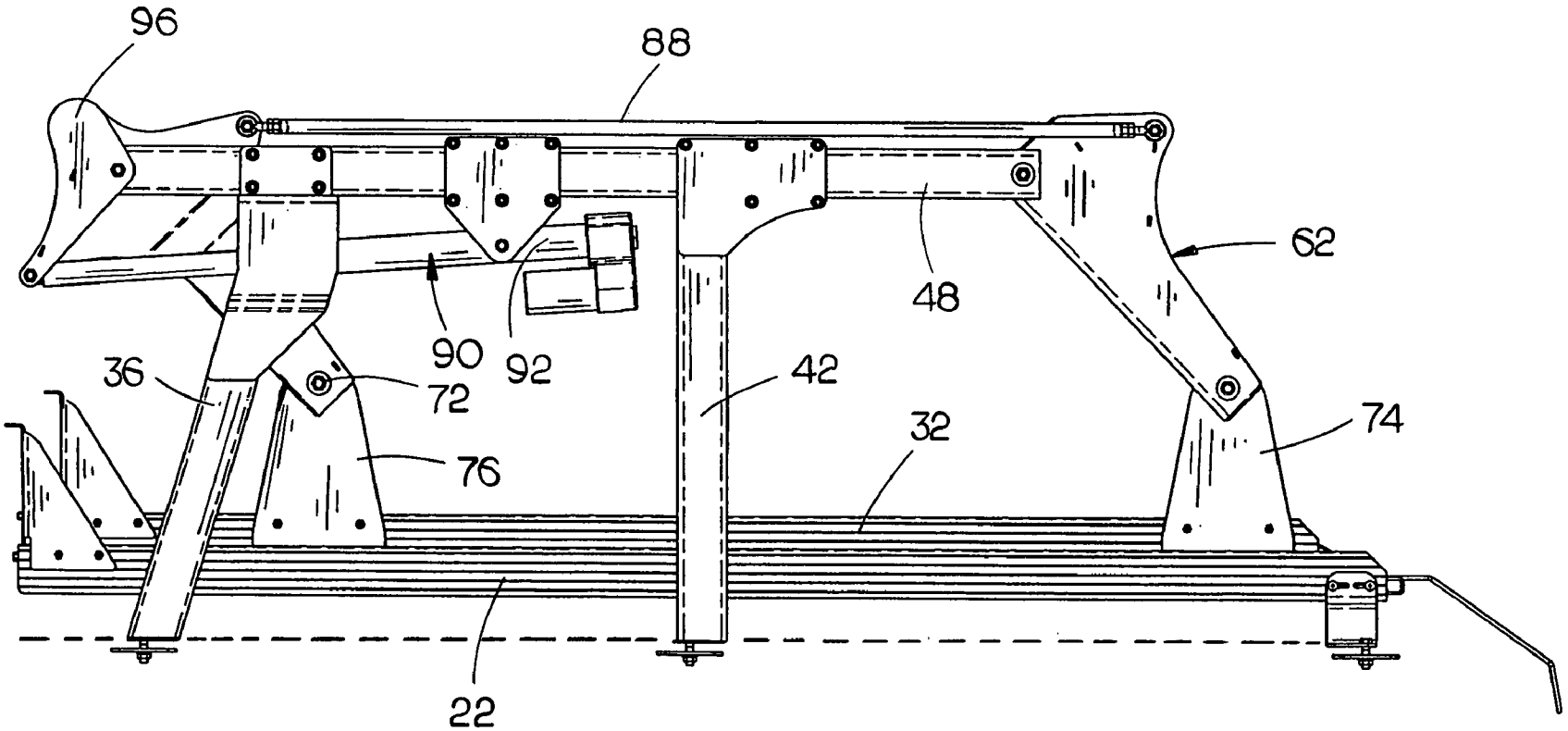
FIG. 8 is a left side view of the invention in the position of FIG. 7.
Figure 9:
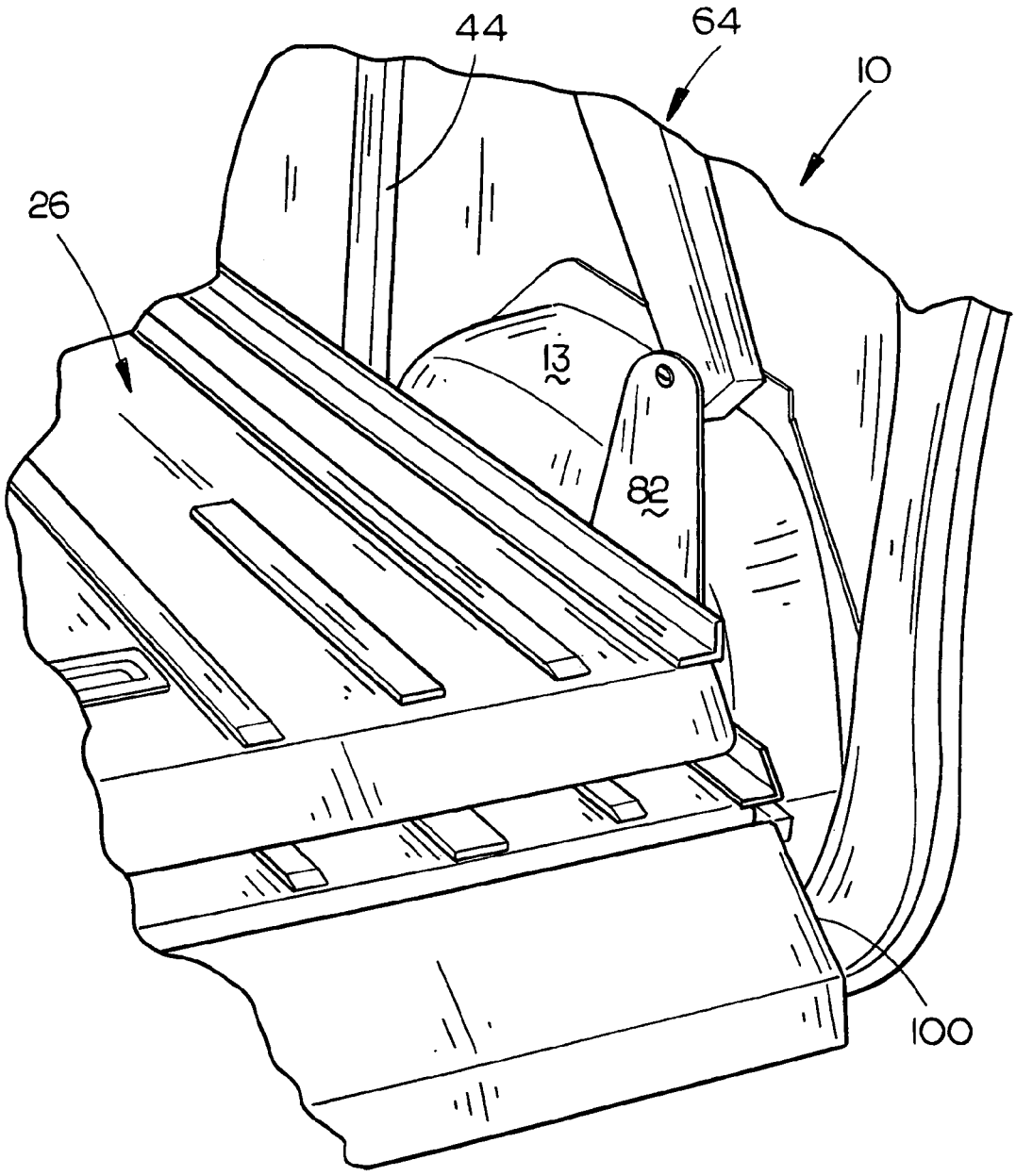
FIG. 9 is a partial rear perspective view of the vehicle and the apparatus of this invention.

The numeral 90 refers to an elongated actuator which is preferably driven by a 12-volt motor or the like and which includes a body 92 and an extendible and retractable actuator shaft 94. Actuator 90 may be a hydraulic cylinder if so desired. As seen in FIGS. 2 and 7, body 92 is longitudinally adjustably and pivotally secured to side frame 48. The end of the actuator shaft 94 is pivotally secured to plate or bracket 96 by bolt 98. Plate 96 forms a part of the hanger bracket assembly 56 so that pivotal movement of plate 96 causes pivotal movement of hanger bracket assembly 56.

A ramp 100 is pivotally connected to the rear end of lower deck 16 and is selectively movable from the transport position of FIGS. 2–4 to the loading-unloading position of FIGS. 5–8. Decks 16 and 26 are provided with upstanding front walls 102 and 104, respectively.

In operation, the apparatus 14 is placed in the cargo area of the small van 10 or the like. Depending upon the position of the wheel housings, the supports 42 and 44 will be selectively longitudinally adjusted with respect to the side frames 48 and 50, respectively, so that the supports 42 and 44 are positioned forwardly of the wheel housings. When the actuator shaft 94 is extended from the body 92 of actuator 90, the hanger bracket assemblies 56, 58, 62 and 64 will be pivotally moved with respect to the side frames to lower the upper deck from its raised position of FIG. 2 to its lower position which is directly over and closely adjacent lower deck 16 (FIG. 7). Retraction of the actuator shaft 94 into the body 92 of the cargo compartment 12 which projects into actuator 90 causes the hanger bracket assemblies 56, 58, 62 and 64 to pivot with respect to the side frames to raise the upper deck 26 to its upper position of FIGS. 2–5.

As can be seen, the upper deck 26 is raised and lowered by a single actuator 90. Preferably, the main system framework is comprised of a steel material while the frames for the decks are aluminum. As stated, the supports 42 and 44 are positioned ahead of the vehicle wheel housings and are adjustable to compensate for various wheelbases since the side frames 48 and 50 cantilever rearwardly over the wheel housings. Such a configuration allows the system to be mounted in vehicles which have no space for a support leg between the wheel housing and the rear of the van. By elevating the side frames 48 and 50 higher than they need to be to clear the wheel housings and attaching the upper deck with a hanger bracket on each corner, the rear swing arms do not interfere with the wheel housings as they go through their motion. Such allows flexibility for the fore/aft mounting position regardless of the wheel housing location in the vehicles.

Thus it can be seen that the invention accomplishes at least all of its stated objectives.

We claim:

1. In combination with a vehicle having an interior compartment above a floor, the vehicle having rearward and forward ends and a door at the rearward end thereof to permit selective access to the interior compartment, comprising:

a generally horizontally disposed lower casket support deck having a forward end, a rearward end, and first and second sides;

first and second upstanding supports, having upper and lower ends, positioned outwardly of said first and second sides of said lower deck, respectively, at said forward end of said lower deck;

third and fourth upstanding supports, having upper and lower ends, positioned outwardly of said first and second sides of said lower deck, respectively, forwardly of said rearward end of said lower deck;

a first side frame having forward and rearward ends, mounted on said first and third supports at said upper ends thereof;

said forward end of said first side frame being positioned forwardly of said upper end of said first support;

said rearward end of said first side frame being positioned rearwardly of said upper end of said third support;

a second side frame, having forward and rearward ends, mounted on said rearward ends, mounted on said second and fourth supports at said upper ends thereof;

said forward end of said second side frame positioned forwardly of said upper end of said second support;

said rearward end of said second side frame being positioned rearwardly of said upper end of said fourth support;

a generally horizontally disposed upper casket support deck having a forward end, a rearward end, and first and second sides;

said upper deck being movably positioned above said lower deck between said first, second, third and fourth supports;

said upper deck being selectively movable between a lower position and an upper position;

said upper deck being spaced above said lower deck when in its upper position;

said upper deck being positioned adjacent said lower deck when it its said lower position;

a first hanger bracket assembly pivotally connected to said first side frame at said forward end thereof and pivotally connected to said first side of said upper deck at said forward end thereof;

a second hanger bracket assembly pivotally connected to said second side frame at said forward end thereof and pivotally connected to said second side of said upper deck;

a third hanger bracket assembly pivotally connected to said first side frame at said rearward end thereof and pivotally connected to said first side of said upper deck;

a fourth hanger bracket assembly pivotally connected to said second side frame at said rearward end thereof and pivotally connected to said second side of said upper deck;

a first connecting rod pivotally connected to and extending between said first and third hanger bracket assemblies;

a second connecting rod pivotally secured to and extending between said second and fourth hanger bracket assemblies;

an elongated actuator including a body portion and an actuator shaft movable extending therefrom, said actuator shaft being movable between retracted and extended positions;

said body portion of said actuator being operably secured to said first side frame;

said actuator shaft of said actuator being operably secured to said first hanger bracket assembly;

said first and second hanger bracket assemblies being operably interconnected so that pivotal movement of said first hanger bracket assembly by said actuator causes said second hanger bracket assembly to pivotally move therewith;

said upper deck being in its said upper position when said actuator shaft is in its said retracted position;

said upper deck being in its said lower position when said actuator shaft is in its said extended position.

2. The combination of claim 1 wherein said third and fourth supports are selectively longitudinally adjustably secured to said first and second side frames, respectively.

3. The combination of claim 1 wherein said upper deck has first, second, third and fourth upstanding brackets, having upper and lower ends, secured thereto; said first bracket being secured to said first side of said upper deck adjacent said forward end thereof; said second bracket being secured to said second side of said upper deck adjacent said forward end thereof; said third bracket being secured to said first side of said upper deck adjacent said rearward end thereof; said fourth bracket being secured to said second side of said upper deck adjacent said rearward end thereof; said first, second, third and fourth hanger brackets being pivotally secured to said upper ends of said first, second, third and fourth brackets, respectively.

4. The combination of claim 1 wherein said actuator is selectively longitudinally adjustably secured to said first side frame.

5. The combination of claim 1 wherein a first frame member is secured to and extends between said lower ends of said first and second supports beneath said lower deck and wherein a second frame member is secured to and extends between said lower ends of said third and fourth supports beneath said lower deck.

6. The combination of claim 5 wherein said first and second frame members are securable to the floor of the vehicle.

7. The combination of claim 1 wherein the interior compartment of the vehicle has a pair of wheel housings extending thereinto and wherein said third and fourth supports are positioned forwardly of the wheel housings.

* * * * *